US009348294B2

(12) United States Patent
Awamura et al.

(10) Patent No.: US 9,348,294 B2
(45) Date of Patent: May 24, 2016

(54) IMAGE FORMING APPARATUS, IMAGE FORMING SYSTEM, AND IMAGE FORMING METHOD

(71) Applicants: Naoya Awamura, Kanagawa (JP); Hiroaki Suzuki, Chiba (JP)

(72) Inventors: Naoya Awamura, Kanagawa (JP); Hiroaki Suzuki, Chiba (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 14/471,628

(22) Filed: Aug. 28, 2014

(65) Prior Publication Data

US 2015/0063886 A1 Mar. 5, 2015

(30) Foreign Application Priority Data

Aug. 29, 2013 (JP) ..... 2013-178573

(51) Int. Cl.
*G03G 15/00* (2006.01)

(52) U.S. Cl.
CPC ..... *G03G 15/6585* (2013.01)

(58) Field of Classification Search
CPC ..... G03G 15/6585
See application file for complete search history.

(56) References Cited

U.S. PATENT DOCUMENTS

2008/0298860 A1 12/2008 Omata
2011/0206429 A1 8/2011 Terao et al.
2012/0014702 A1* 1/2012 Takemura ..... 399/46
2012/0051816 A1 3/2012 Chiyoda
2012/0062956 A1 3/2012 Kitagawa et al.
2012/0063802 A1* 3/2012 Suzuki et al. ..... 399/82
2012/0155939 A1* 6/2012 Fukatsu et al. ..... 399/341

FOREIGN PATENT DOCUMENTS

JP 2008-299254 12/2008
JP 2010152129 * 7/2010
JP 2011-180391 9/2011
JP 2012-022113 2/2012
JP 2012-037618 2/2012
JP 2012-053239 3/2012

OTHER PUBLICATIONS

Machine Translation of JP2010152129.*

* cited by examiner

*Primary Examiner* — Clayton E Laballe
*Assistant Examiner* — Ruifeng Pu
(74) *Attorney, Agent, or Firm* — Oblon, McClelland, Maier & Neustadt, L.L.P.

(57) ABSTRACT

An image forming apparatus that forms an image to which a plurality of various surface gloss effects are given by overlaying clear toner to be fixed for a plurality of times on a recording material on which color toner has been transferred, the image processing apparatus comprises a determining unit that determines number of times of fixing clear toner onto the recording material for each image region, according to a surface gloss effect of an image region that is indicated by input image data; and a clear-image forming unit that generates a clear toner plane for each image region having been determined that the number of times of fixing clear toner is same by the determining unit, and forms a clear image.

9 Claims, 11 Drawing Sheets

| CMYK TOTAL AMOUNT [%] | GLOSS FUSING FREQUENCY [TIMES] | MATT FUSING FREQUENCY [TIMES] | WATERMARK, TEXTURE FUSING FREQUENCY [TIMES] |
|---|---|---|---|
| 0 TO 50 | 4 | 3 | 2 |
| 51 TO 100 | 3 | 2 | 2 |
| 101 TO 150 | 3 | 2 | 1 |
| 151 TO 200 | 2 | 1 | 1 |
| 201 TO 250 | 2 | 1 | 1 |
| 251 TO 300 | 1 | 1 | 1 |
| 301 TO 350 | 1 | 1 | 1 |
| 351 TO 400 | 1 | 1 | 1 |

| GLOSS CONTROL TYPE | GLOSS | DEVIATION |
|---|---|---|
| MIRROR FINISH GLOSS (PG) | Gs≥80 | ΔGs≤10 |
| SOLID GLOSS (G) | Gs=Gs (SOLID GLOSS) | ΔGs≤10 |
| DOT MATT (M) | Gs=Gs (1C 30% HALFTONE DOT) | ΔGs≤10 |
| MAT (PM) | Gs≤10 | ΔGs≤10 |

FIG.4

| DEN-SITY [%] | DENSITY | | | EFFECT | GLOSSER ON/OFF (ON/OFF INFORMATION) | CLEAR TONER PLANE 1 (PRINTER UNIT) | CLEAR TONER PLANE 2 (LOW TEMPERATURE FUSER) |
|---|---|---|---|---|---|---|---|
| | REP-RE-SENT-ATIVE VALUE | VALUE RANGE | | | | | |
| 98% | 250 | 248 | 255 | MIRROR-FINISH GLOSS TYPE A | ON | INVERSE MASK A | NO DATA |
| 96% | 245 | 243 | 247 | MIRROR-FINISH GLOSS TYPE B | ON | INVERSE MASK B | NO DATA |
| 94% | 240 | 238 | 242 | MIRROR-FINISH GLOSS TYPE C | ON | INVERSE MASK C | NO DATA |
| 92% | 235 | 233 | 237 | RESERVED | | | |
| 90% | 230 | 228 | 232 | SOLID GLOSS TYPE 1 | OFF | INVERSE MASK 1 | NO DATA |
| 88% | 224 | 222 | 227 | SOLID GLOSS TYPE 2 | OFF | INVERSE MASK 2 | NO DATA |
| 86% | 219 | 217 | 221 | SOLID GLOSS TYPE 3 | OFF | INVERSE MASK 3 | NO DATA |
| 84% | 214 | 212 | 216 | SOLID GLOSS TYPE 4 | OFF | INVERSE MASK 4 | NO DATA |
| 82% | 209 | 207 | 211 | RESERVED | | | |
| 46% | 117 | 115 | 119 | RESERVED | | | |
| 44% | 112 | 110 | 114 | WATERMARK CHARACTER 3 (XXX) | OFF | NO DATA | TILE CHARACTER STRING 3 |
| 42% | 107 | 105 | 109 | WATERMARK CHARACTER 2 (COPY PROHIBITED) | | NO DATA | TILE CHARACTER STRING 2 |
| 40% | 102 | 100 | 104 | WATERMARK CHARACTER 1 (SAMPLE) | | NO DATA | TILE CHARACTER STRING 1 |
| 38% | 97 | 95 | 99 | RESERVED | | | |
| 36% | 92 | 90 | 94 | RESERVED | | | |
| 34% | 87 | 85 | 89 | BACKGROUND PATTERN 3 (XXX) | | NO DATA | TILE BACKGROUND 3 |
| 32% | 82 | 80 | 84 | BACKGROUND PATTERN 2 (GRID) | | NO DATA | TILE BACKGROUND 2 |
| 30% | 76 | 74 | 79 | BACKGROUND PATTERN 1 (WAVE) | | NO DATA | TILE BACKGROUND 1 |
| 28% | 71 | 69 | 73 | RESERVED | | | |
| 26% | 66 | 64 | 68 | RESERVED | | | |
| 24% | 61 | 59 | 63 | TACTILE PATTERN TYPE 3 (ROUGH) | | NO DATA | TILE HALFTONE PATTERN 3 |
| 22% | 56 | 54 | 58 | TACTILE PATTERN TYPE 2 (INTERMEDIATE) | | NO DATA | TILE HALFTONE PATTERN 2 |
| 20% | 51 | 49 | 53 | TACTILE PATTERN TYPE 1 (FINE) | | NO DATA | TILE HALFTONE PATTERN 1 |
| 18% | 46 | 44 | 48 | RESERVED | | | |
| 16% | 41 | 39 | 43 | HALFTONE DOT MATT TYPE 4 | OFF | HALFTONE 4 | NO DATA |
| 14% | 36 | 34 | 38 | HALFTONE DOT MATT TYPE 3 | OFF | HALFTONE 3 | NO DATA |
| 12% | 31 | 29 | 33 | HALFTONE DOT MATT TYPE 2 | OFF | HALFTONE 2 | NO DATA |
| 10% | 25 | 23 | 28 | HALFTONE DOT MATT TYPE 1 | OFF | HALFTONE 1 | NO DATA |
| 8% | 20 | 18 | 22 | RESERVED | | | |
| 6% | 15 | 13 | 17 | MATT TYPE C | ON&OFF | NO DATA | SOLID |
| 4% | 10 | 8 | 12 | MATT TYPE B | ON&OFF | NO DATA | SOLID |
| 2% | 5 | 1 | 7 | MATT TYPE A | ON&OFF | NO DATA | SOLID |
| 0% | 0 | 0 | 0 | N/A | OFF | NO DATA | NO DATA |

| CMYK TOTAL AMOUNT [%] | GLOSS FUSING FREQUENCY [TIMES] | MATT FUSING FREQUENCY [TIMES] | WATERMARK, TEXTURE FUSING FREQUENCY [TIMES] |
|---|---|---|---|
| 0 TO 50 | 4 | 3 | 2 |
| 51 TO 100 | 3 | 2 | 2 |
| 101 TO 150 | 3 | 2 | 1 |
| 151 TO 200 | 2 | 1 | 1 |
| 201 TO 250 | 2 | 1 | 1 |
| 251 TO 300 | 1 | 1 | 1 |
| 301 TO 350 | 1 | 1 | 1 |
| 351 TO 400 | 1 | 1 | 1 |

IMAGE FORMING APPARATUS, IMAGE FORMING SYSTEM, AND IMAGE FORMING METHOD

CROSS-REFERENCE TO RELATED APPLICATIONS

The present application claims priority to and incorporates by reference the entire contents of Japanese Patent Application No. 2013-178573 filed in Japan on Aug. 29, 2013.

BACKGROUND OF THE INVENTION

1. Field of the Invention

The present invention relates to an image forming apparatus, an image forming system, and an image forming method.

2. Description of the Related Art

Conventionally, an image forming apparatus in which clear toner that is colorless toner without color material is mounted besides toners of four colors of CMYK has been available. A toner image that is formed with such clear toner is fixed on a recording medium, such as a transfer sheet, on which an image has been formed with CMYK toner. As a result, a visual effect or a tactile effect (referred to as surface effect) are produced on a surface of the recording medium. The surface effect to be produced varies depending on what kind of toner image is formed with clear toner and how the image is fixed. The surface effect can be of simply giving a gloss, or of reducing a gloss. Moreover, not just giving a surface effect on an entire surface, a surface effect of giving the effect only on a part of a surface, or a surface effect of giving a texture or a watermark is also demanded. Furthermore, surface protection can be demanded. Moreover, there is a surface effect that is produced by performing postprocessing by a dedicated postprocessor such as a glosser and a low-temperature fuser, besides a fixation control. In recent years, a technique in which clear toner is fixed only on a desirable portion in a part of a surface to give a gloss has been developed.

Furthermore, in Japanese Patent Application Laid-open No. 2012-37618, an image forming apparatus has been disclosed that forms an image (overprinting) using clear toner on a recording material (sheet) on which color toner, or color toner and clear toner have been fixed.

However, there has been a problem that if overprinting is performed to produce a high-gloss effect (mirror finish and the like), the glossiness increases even in a region in which a low gloss effect (matt finish) is to be produced.

In view of the above problem, there is a need to provide an image forming apparatus, an image forming system, and an image forming method by which an image can be formed, appropriately giving a surface gloss effect for each of image regions indicated by image data.

SUMMARY OF THE INVENTION

It is an object of the present invention to at least partially solve the problems in the conventional technology.

According to the present invention, there is provided an image forming apparatus that forms an image to which a plurality of various surface gloss effects are given by overlaying clear toner to be fixed for a plurality of times on a recording material on which color toner has been transferred, the image processing apparatus comprising: a determining unit that determines number of times of fixing clear toner onto the recording material for each image region, according to a surface gloss effect of an image region that is indicated by input image data; and a clear-image forming unit that generates a clear toner plane for each image region having been determined that the number of times of fixing clear toner is same by the determining unit, and forms a clear image.

The present invention also provides an image forming system that forms an image to which a plurality of various surface gloss effects are given by overlaying clear toner to be fixed for a plurality of times on a recording material on which color toner has been transferred, the image processing system comprising: a determining unit that determines number of times of fixing clear toner onto the recording material for each image region, according to a surface gloss effect of an image region that is indicated by input image data; and a clear-image forming unit that generates a clear toner plane for each image region having been determined that the number of times of fixing clear toner is same, and forms a clear image.

The present invention also provides an image forming method of forming an image to which a plurality of various surface gloss effects are given by overlaying clear toner to be fixed for a plurality of times on a recording material on which color toner has been transferred, the image processing method comprising: determining number of times of fixing clear toner onto the recording material for each image region, according to a surface gloss effect of an image region that is indicated by input image data; and generating a clear toner plane for each image region having been determined that the number of times of fixing clear toner is same, and forming a clear image.

The above and other objects, features, advantages and technical and industrial significance of this invention will be better understood by reading the following detailed description of presently preferred embodiments of the invention, when considered in connection with the accompanying drawings.

BRIEF DESCRIPTION OF THE DRAWINGS

FIG. 4 exemplifies a data configuration of a surface-effect selection table;

DETAILED DESCRIPTION OF THE PREFERRED EMBODIMENTS

An image forming apparatus, an image forming system, and an image forming method according to an embodiment are explained in detail below with reference to the accompanying drawings.

First Embodiment

Figures 1, 2:
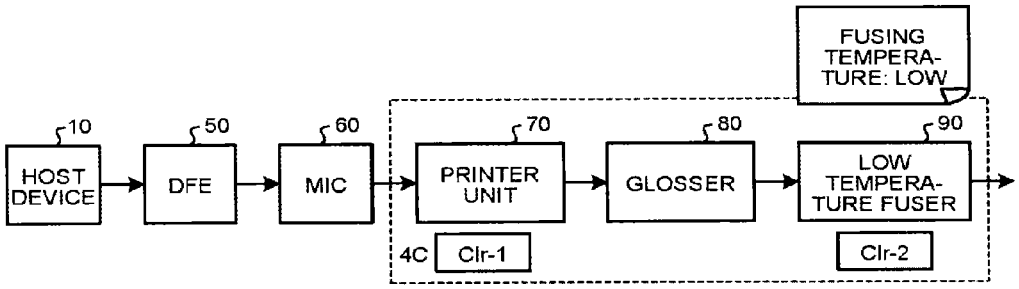
FIG. 1 is a block diagram exemplifying a configuration of an image forming system according to a first embodiment of the present invention.
FIG. 2 is a table exemplifying types of surface effects relating to glossiness.

First, a configuration example of an image forming system, according to a first embodiment is explained using FIG. 1. In the first embodiment, the image forming system is configured with a printer control device (DFE) 50 (hereinafter, "DFE 50"), an interface (I/F) controller (mechanism I/F controller (MIC)) 60 (hereinafter, "MIC 60"), a printer unit 70, and a glosser 80 and a low temperature fuser 90 as postprocessors connected. The DFE 50 performs communication with the printer unit 70 through the MIC 60, and controls image forming at the printer unit 70. Moreover, to the DFE 50, a host device 10 such as a personal computer (PC) is connected. The DFE 50 receives image data from the host device 10, and generates image data to form a toner image corresponding to each toner of CMYK and clear toner by the printer unit 70, and transmits the image data to the printer unit 70 through the MIC 60. In the printer unit. 70, at least respective toner in CMYK and clear toner are mounted, and an image forming unit that includes a photoconductor, a charging device, a developing device, and a photoconductor cleaner, an exposer, and a fuser are equipped for each toner.

The clear toner is transparent (colorless) toner including no colorant. Transparent (colorless) means that transparency is 70% or higher, for example.

The printer unit 70 forms, on the photoconductor, a toner image corresponding to each toner by irradiating light beams from the exposer according to image data that is transmitted from the DFE 50 through the MIC 60. The formed toner image is transferred onto a recording material such as transfer paper, and is fixed by applying heat in at temperature within a predetermined range (normal temperature) and pressure by the fuser. Thus, an image is formed on the recording material. The configuration of the printer unit 70 as described has been widely known, and therefore, detailed explanation thereof is omitted.

The glosser 80 is controlled to be turned on and off by on/off information specified by the DFE 50, and when turned on, applies pressure at high temperature and high pressure on an image formed on a recoding material by the printer unit 70, and thereafter, cools the image and removes the recording material on which the image is formed from a main unit. Thus, the total toner adhesion amount of each pixel on which more than a predetermined amount of toner adheres in the entire image formed on the recording material is uniformly compressed. In the low temperature fuser 90, an image forming unit that includes a photoconductor, a charging device, a developing device, and a photoconductor cleaner for clear toner, and an exposer, and a fuser to fix the clear toner are equipped, and to use the low temperature fuser 90, image data of a clear toner plane that is generated by the DFE 50 described later is input. The low temperature fuser 90 forms, when the DFE 50 generates image data of clear toner plane (clear-toner plane data) to be used by the low temperature fuser 90, a toner image using this data, and superimposes the toner image on a recording material pressed by the glosser 80 to be fixed on the recording material by heat and pressure lower than a normal case by the fuser.

Image data (original data) that is input by the host device 10 is explained. In the host device 10, an image data is generated by an image processing application installed in advance, to be transmitted to the DFE 50. In such an image processing application, image data of a special color plane can be handled for image data for which color density value (referred to as density value) of each color in each color plane of RGB or CMYK planes is prescribed for each pixel. The special color plane is image data to adhere special toner or ink such as white, gold, and silver, other than basic colors such as CMYK and RGB, and is data for printer in which such special toner or ink is mounted. With the special color plane, to improve color reproducibility, addition of R to basic colors of CMYK, or addition of Y to basic colors of RGB may be practiced. Usually, clear toner is also handled as one of special colors.

In the first embodiment, this clear toner as a special color is used to produce a surface effect that is a visual or tactile effect to be added onto a recoding material, and to form a transparent image such as a watermark and a texture on a recording material.

Therefore, the image processing application in the host device 10 generates, according to input image data, image data of a gloss control plane and/or image data of clear plane as image data of a special plane besides image data of a color plane, based on specification by a user.

The image data of a color plane is image data for which density values of colors such as RGB and CMYK are prescribed for each pixel. In this image data of a color plane, one pixel is expressed by 8 bits based on specification of colors by a user.

Moreover, the image data of a gloss control plane is image data in which a region to which a surface effect is to be given and a type of the surface effect are specified, to perform control of fixing clear toner according the surface effect that is a visual or tactile effect to be added to a recording material.

Note that image data of a gloss control plane is an image to be a base when one or more pieces of image data of a clear toner are generated. The clear toner plane is image data that is generated for each image region for which the number of times of fixing clear toner is identical, and is to apply clear toner (see FIG. 9).

Furthermore, the image data of a clear plane is image data in which a transparent image such as a watermark and a texture is specified. Moreover, a generic name of an image that is fixed on a recording material using clear toner is a clear image (that is, images formed by a gloss control plane and a clear plane).

The gloss control plane is expressed, similarly to the color plane of RGB, CMYK, or the like, with density values in a range of "0" to "255" in 8 bits for each pixel, and a type of a surface effect is associated with this density value (the density value may be expressed in 16 bits or 32 bits, or in 0% to 100%). The gloss control plane indicates a type of a surface effect, and a region to which the surface effect is given.

The host device 10 sets a type of a surface effect for a drawing object specified by a user with the image processing application as a density value as a gloss control value for each drawing object, and generates image data of a gloss control plane in a vector format.

Each pixel constituting this image data of a gloss control plane corresponds to a pixel of image data of a color plane. In each image data, a density value expressed by each pixel is to be a pixel value.

Types of the clear image broadly includes one relating to a gloss, surface protection, watermark in which information is embedded, a texture, and the like. As for the one relating to a gloss, there are four types broadly as shown in FIG. 2, including various types such as mirror finish gloss (PG: premium gloss), solid gloss (G: gloss), halftone dot matt (M: matt), and matt (PM: premium matt) in descending order in glossiness. Hereinafter, mirror finish gloss may be referred to as "PG", solid gloss as "G", halftone dot matt as "M", and matt as "PM" in some cases.

The mirror finish gloss and the solid gloss have a higher degree of glossiness, and on the other hand, the halftone dot matt and the matt are to reduce a gloss, and particularly, the matt is to achieve glossiness lower than the glossiness of an ordinary recording material. In the same figure, it is indicated that the mirror finish gloss has the glossiness of 80 or higher, the solid gloss has solid glossiness produced by a primary color or a secondary color, the halftone dot matt has the glossiness of a primary color and of 30% in dots, and the matt has the glossiness of 10 or lower. Moreover, a deviation of the glossiness is expressed as AGS, and is 10 or smaller. To the respective types of the surface effect, a higher density value is associated to a surface effect having a higher degree of glossiness. Intermediate density values are associated with a surface effect such as a watermark and a texture. As a watermark, for example, characters and background patterns are used. A texture is to express a character or a pattern, and can produce a tactile effect in addition to a visual effect. For example, a pattern of stained glass can be produced with clear toner. The mirror finish gloss and the solid gloss substitute the surface protection. A region in which a surface effect is given in an image that is expressed by image data to be processed, and a type of surface effect to be given to the region are specified by a user through the image processing application. In the host device 10, a density value corresponding to a surface effect that is specified by the user is set for a drawing object that constitutes the region specified by the user, thereby generating image data of a gloss control plane. The correspondence between a density value and a surface effect is described later.

Figure 3:
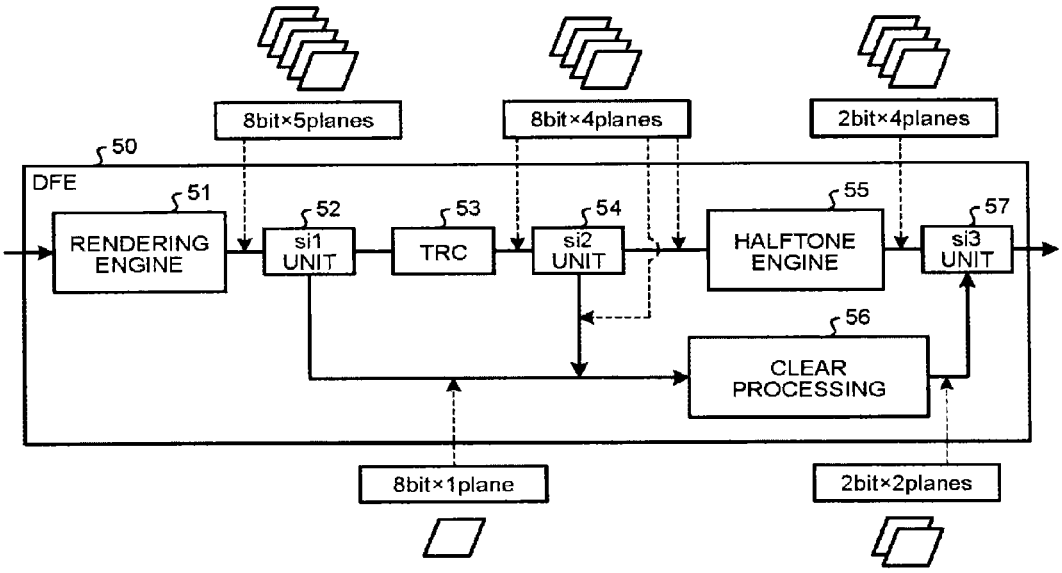
FIG. 3 is a block diagram exemplifying a functional configuration of a digital front end (DFE)

Next, a functional configuration of the DFE 50 is explained. The DEE 50 includes a rendering engine 51, an si1 unit 52, a tone reproduction curve (TRC) 53, an si2 unit 54, a halftone engine 55, a clear processing 56, an si3 unit 57, and a surface-effect selection table (not shown) as shown in FIG. 3. The rendering engine 51, the si1 unit 52, the TRC 53, the si2 unit 54, the halftone engine 55, the clear processing 56, and the si3 unit 57 are implemented by executing various kinds of programs stored in a main storage unit or an auxiliary storage unit by a control unit in the DEE 50. Either of the si1 unit 52, the si2 unit 54, and the si3 unit 57 has a function of separating image data, and a function of integrating image data. The surface-effect selection table is stored in, for example, an auxiliary storage unit.

To the rendering engine 51, image data that has been transmitted from the host device 10 is input. The rendering engine 51 interprets a language of the input image data, converts the image data expressed in a vector format into a raster format, and converts a color space expressed in RGB or the like into a color space in a CMYK format, thereby outputting respective 8-bit image data of color planes of CMYK and an 8-bit gloss control plane. The si1 unit 52 outputs the respective 8-bit image data of CMYK to the TRC 53, and outputs, for example, the 8-bit gloss control plane to the clear processing 56. The DEE 50 converts the image data of a gloss control plane in a vector format output from the host device 10 into a raster format, and as a result, the DFE 50 outputs image data of a gloss control plane, setting a type of surface effect for a drawing object specified by the user with the image processing application as a density value in a pixel unit.

To the TRC 53, the respective 8-bit image data of CMYK are input through the si1 unit 52. The TRC 53 performs gamma correction with a gamma curve of 1D_LUT that is generated by calibration to the input image data. As image processing, there also is toner total-amount control, or the like other than the gamma correction; however, it is omitted in an example of this embodiment. The si2 unit 54 outputs the respective 8-bit image data of CMYK on which the gamma correction has been performed by the TRC 53 to the clear processing 56 as data to generate an inverse mask (described later). To the halftone engine 55, the respective 8-bit image data of CMYK subjected to the gamma correction are input through the si2 unit 54. The halftone engine 55 performs halftone processing to convert the input image into a data format of, for example, image data of CMYK in 2 bits each, to output to the printer unit 70, and outputs the image data subjected to the halftone processing, such as image data of CMYK in 2 bits each. Note that 2 bits is an example, and it is not limited thereto.

To the clear processing 56, the 8-bit gloss control plane obtained by conversion performed by the rendering engine 51 is input through the si1 unit 52, and the respective 8-bit image data of CMYK on which the gamma correction has been performed by the TRC 53 are input through the si2 unit 54. The clear processing 56 uses the input gloss control plane and determines a surface effect corresponding to a density value (pixel value) indicated by each pixel constituting the gloss control plane by referring to the surface-effect selection table described later. According to the determination, the clear processing 56 determines whether to turn on or off the glosser 80, and generates an inverse mask or a solid mask as appropriate using the respective input 8-bit image data of CMYK, thereby generating 2-bit image data of a clear toner plane to apply clear toner appropriately. According to a result of the determination about a surface effect, the clear processing 56 appropriately generates image data of a clear toner plane to be used in the printer unit 70 and image data of a clear toner plane to be used in the low temperature fuser 90 to output, and outputs on/off information that indicates on or off of the glosser 80.

The inverse mask is to make the total adhesion amount of CMYK toner and clear toner on each pixel constituting an object region to which a surface effect is given uniform. Specifically, in the image data of a CMYK plane, density values of pixels constituting the object region are all added, and image data in which the sum is subtracted form a predetermined value is to be the inverse mask. For example, an inverse mask 1 described above is expressed by following Equation (1).

$$Clr=100-(C+M+Y+K),\ \text{where } Clr=0 \text{ when } Clr<0 \quad (1)$$

Clr, C, M, Y, and K in Equation (1) indicate density rates converted form density values of respective pixels for respective toner of clear toner, C, M, Y, and K. That is, by Equation (1), the total adhesion amount that is obtained by adding the adhesion amount of clear toner to the total adhesion amount of respective toners of C, M, Y, and K is made into 100% for all of pixels constituting an object region to which a surface effect is given. When the total adhesion amount of respective toners of C, M, Y, and K is 100% or higher, clear toner is not to be applied, and the density rate thereof is made into 0%.

This is because a part in which the total adhesion amount of respective toners of C, M, Y, and K exceeds 100% is smoothed by the fusing processing. As described, by making the total adhesion amount on all pixels constituting an object region to which a surface effect is given into 100%, unevenness on a surface caused by difference in the total adhesion amount of toner in the object region is eliminated, and as a result, a gloss is produced by specular reflection of light. Note that there is an inverse mask that is calculated by one other than Equation (1), and there may be more than one type of inverse mask.

For example, the inverse mask may be one to adhere clear toner uniformly on each pixel. In this case, the inverse mask is also referred to as solid mask, and is expressed by Equation (2) below.

$$Clr=100 \tag{2}$$

It may be arranged such that a density rate other than 100% is assigned to some pixels among object pixels to which a surface effect is given, and a solid mask can have more than one pattern.

Moreover, for example, the inverse mask may be one calculated by multiplication of the background exposure rates of respective colors. In this case, the invert mask is expressed by, for example, Equation (3) below.

$$Clr=100\times\{(100-C)/100\}\times\{(100-M)/100\}\times\{(100-Y)/100\}\times\{(100-K)/100\} \tag{3}$$

In the above equation, (100−C)/100 indicates the background exposure rate of C, (100−M)/100 indicates the background exposure rate of M, (100−Y)/100 indicates the background exposure rate of Y, and (100−K)/100 indicates the background exposure rate of K.

Furthermore, the inverse mask may be one calculated by a method assuming that a halftone dot having the maximum area ratio controls smoothness. In this case, the inverse mask is expressed by, for example, Equation (4) below.

$$Clr=100-\max(C,M,Y,K) \tag{4}$$

In Equation (4) above, max(C, M, Y, K) indicates that the density value of a color having the maximum density value among CMYK is to be the representative value.

In other words, the inverse mask may be either one among ones expressed by Equations (1) to (4) described above.

The surface-effect selection table is a table indicating correspondence between a density value as a gloss control value indicating a surface effect and a type of surface effect, control information relating to a postprocessor according to a configuration of the image forming system, and correspondence between image data of a clear toner plane used in the printer unit 70 and image data of a clear toner plane used in the postprocessor. Although the configuration of the image forming system can take various forms, in the first embodiment, a configuration in which the glosser 80 and the low temperature fuser 90 are connected to the printer unit 70 as the postprocessors is adopted. The control information relating to the postprocessor according to the configuration of the image forming system is on/off information that indicates whether to turn on or off the glosser 80. Moreover, as the image data of a clear toner plane used in the postprocessor, image data of a clear toner plane used in the low temperature fuser 90 is included. FIG. 4 exemplifies a data configuration of the surface-effect selection table. The surface-effect selection table can be configured so as to indicate the control information relating to the postprocessor, image data of a clear toner plane 1 used in the printer unit 70 and image data of a clear toner plane 2 used in the postprocessor, and the correspondence between a density value and a surface effect for each different configuration of the mage forming system, and in FIG. 4, a data configuration according to the configuration of the image forming system according to the first embodiment is exemplified. In the correspondence between a surface effect and a density value indicated in the table, each type of surface effect is associated with each range of density values. Furthermore, for a rate of density (density rate) converted from a value representing the range of density values (representative value), each type of surface effect is assigned to each 2% increments. Specifically, to a range ("212" to "255") of density values in which the density rate is 84% or higher, surface effects (mirror finish effect and solid gloss effect) of giving a gloss are assigned, and a range ("1" to "43") of density values in which the density rate is 16% or lower, surface effects (halftone dot matt and matt) of reducing a gloss are assigned. Moreover, in a range of density values in which the density rate is 20% to 80%, surface effects such as a texture and a background watermark are assigned.

More specifically, for example, to pixel values of "238" to "255", the mirror finish gloss (PM) assigned as the surface effect, and out of these pixel values, to three ranges of pixel values "238" to "242", pixel values "243" to "247", and pixel values "248" to "255", respective different types of mirror finish gloss are assigned. Furthermore, to pixel values of "212" to "232", the solid gloss (G) is assigned, and out of these pixels, to four ranges of pixel values "212" to "216", pixel values "217" to "221", pixel values "222" to "227", and pixel values "228" to "232", respective different types of solid gloss are assigned. Moreover, to pixel values of "23" to "43", the halftone dot matt (M) is assigned, and out of these pixel values, four ranges of pixel values "23" to "28", pixel values "29" to "33", pixel values "34" to "38", and pixel values "39" to "43", respective different types of halftone dot matt are assigned. Furthermore, to pixel values of "1" to "17", the matt (PM) is assigned, and out of these pixel values, three ranges of pixel values "1" to "7", pixel values "8" to "12", and pixel values "13" to "17", respective different types of matt are assigned. These different types in an identical surface effect differ in expressions to calculate image data of a clear toner plane to be used in the printer unit 70 and the low temperature fuser 90, and the operation of a printer main unit and the postprocessors are the same. To the density value of "0", giving no surface effect is assigned.

Moreover, in FIG. 4, the on/off information indicating on or off of the glosser 80, and contents of image data of a clear toner plane 1 used in the printer unit 70 (Clr-1 in FIG. 1) and image data of a clear toner plane 2 used in the low temperature fuser 90 are indicated corresponding to pixel values and surface effects. For example, when the surface effect is the mirror finish gloss, it is indicated that the glosser 80 is turned on, and the image data of a clear toner plane 1 used in the printer unit 70 is one expressed by an inverse mask, and the image data of a clear toner plane 2 used in the low temperature fuser 90 (Clr-2 in FIG. 1) is not present. The inverse mask is, for example, acquired by Equation (1) described above. The example shown in FIG. 4 is an example of a case in which a region for which the mirror finish effect is designated as the surface effect corresponds to the entire region specified by image data. An example of a case in which a region for which the mirror finish effect is designated as the surface effect corresponds to a part of the region specified by image data is described later.

Furthermore, it is indicated that when the density value is from "228" to "232" and the surface effect is the solid gloss, the glosser 80 is turned off, the image data of a clear toner plane 1 used in the printer unit 70 is an inverse mask 1, and the image data of a clear toner plane 2 used in the low temperature fuser 90 is not present. The inverse mask 1 is only required to be one expressed by either equation of Equation (1) to Equation (4) described above. Because the glosser 80 is off, the total adhesion amount of toner to be smoothed varies, and therefore, unevenness on the surface increases compared to the mirror finish gloss, and a solid gloss having lower glossiness than the mirror finish gloss can be obtained as a result. Moreover, it is indicated that when the surface effect is the halftone dot matt, the glosser 80 is off, the image data of a clear toner plane 1 used in the printer unit 70 is one expressing halftone (halftone dots), and the image data of a clear toner plane 2 used in the low temperature fuser 90 is not present. Furthermore, it is indicated that when the surface effect is the matt, the glosser 80 can be either on or off, the image data of a clear toner plane 1 used in the printer unit 70 is not present, and the image data of a clear toner plane 2 used in the low temperature fuser 90 is one expressing a solid mask. The solid mask is, for example, one acquired by Equation (2) described above.

The clear processing 56 refers to the surface-effect selection table described above to determine a surface effect that is assigned to each pixel value indicated by a gloss control plane, to determine whether the glosser 80 is to be on or off, and to determine what kind of image data of a clear toner plane is to be used in the printer unit 70 and the low temperature fuser 90. The clear processing 56 makes determination whether to turn on or off the glosser 80 for every single page. Subsequently, as described above, the clear processing 56 appropriately generates image data of a clear toner plane according to the determination result, outputs this image data, and outputs the on/off information for the glosser 80.

The si3 unit 57 integrates respective 2-bit image data of CMYK subjected to the halftone processing and 2-bit image data of a clear toner plane that is generated by the clear processing 56, and outputs integrated image data to the MIC 60. Note that there is a case in which the clear processing 56 does not generate at least one of the image data of a clear toner plane used in the printer unit 70 and the image data of a clear toner plane used in the low temperature fuser 90, and therefore, the image data of a clear toner plane generated by the clear processing 56 is integrated at the si3 unit 57, and when both of the image data of a clear toner plane are not generated by the clear processing 56, image data in which the respective 2-bit image data of CMYK are integrated is output from the si3 unit 57. As a result, four to six pieces of image data having 2 bits each are transmitted from the DFE 50 to the MIC 60. Furthermore, the si3 unit 57 also outputs, to the MIC 60, the on/off information for the glosser 80 output by the clear processing 56.

The MIC 60 is connected to the DFE 50 and the printer unit 70, and receives image data of a color plane and image data of a clear toner plane from the DFE 50 to distribute the respective data to corresponding devices, and performs control of the postprocessors.

Figure 5:
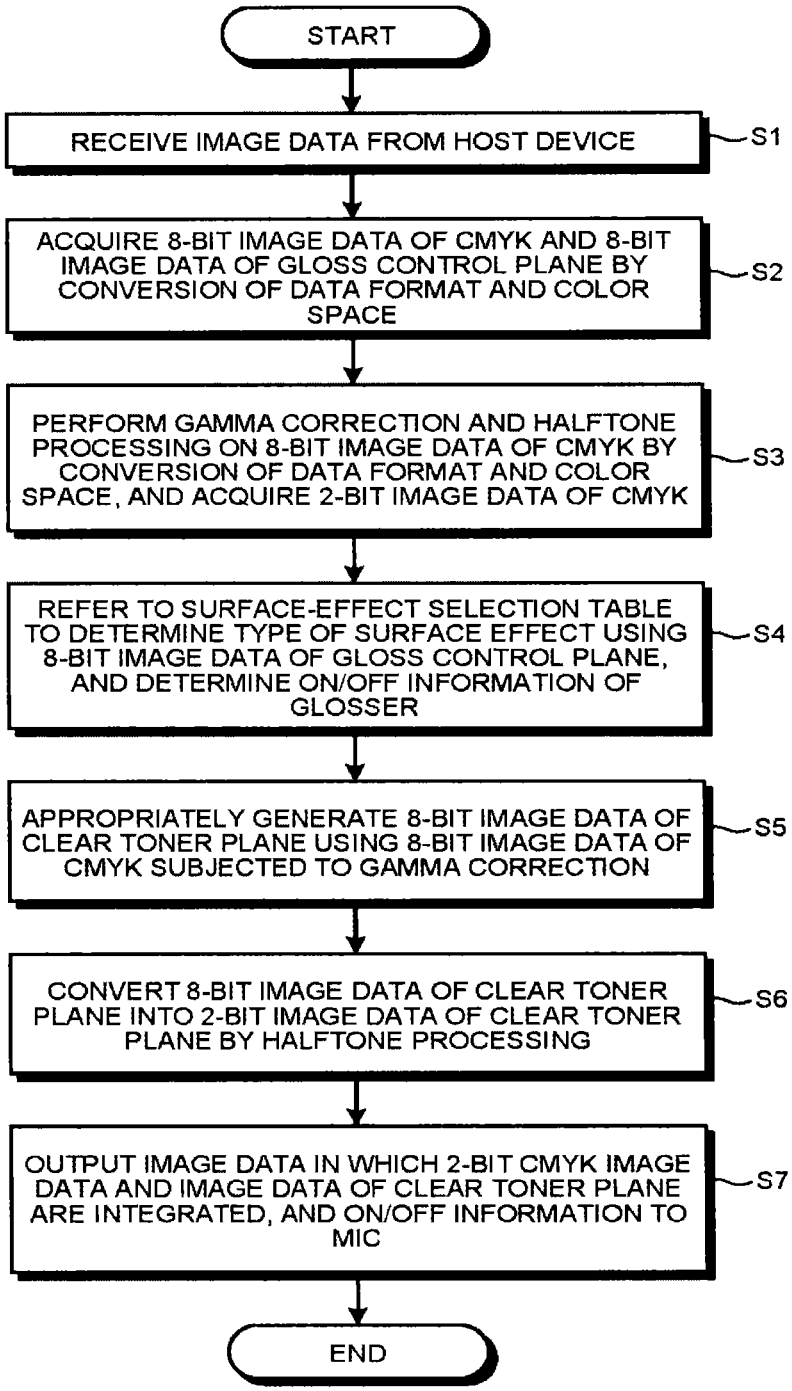
FIG. 5 is a flowchart indicating procedure of gloss control processing that is performed by the image forming system.

Next, procedure of gloss control processing that is performed by the image forming system according to the first embodiment is explained using FIG. 5. When the DFE 50 receives image data from the host device 10 (step S1), the rendering engine 51 interprets a language thereof to convert image data expressed in the vector format into the raster format, and to convert a color space expressed in the RGB format into a color space in the CMYK format, and acquires respective 8-bit image data of color planes of CMYK and an 8-bit gloss control plane (step S2).

When the 8-bit image data of a gloss control plane is output, the TRC 53 of the DFE 50 performs gamma correction with the gamma curve of 1D_LUT that is generated by calibration on the respective 8-bit image data of color planes of CMYK, and the halftone engine 55 performs halftone processing to convert into a data format of respective 2-bit image data of CMYK to be output to the printer unit 70, on the image data subjected to the gamma correction, and thereby acquires respective 2-bit image data of CMYK subjected to the halftone processing (step S3).

Furthermore, the clear processing 56 of the DFE 50 refers to the surface-effect selection table, and determines, using an 8-bit gloss control plane, a surface effect that is specified to each pixel value indicated by the gloss control plane. Thus, the clear processing 56 makes the determination as described for all pixels constituting the gloss control plane. In the gloss control plane, the density value in an identical range is indicated for each image region, for all the pixels constituting the image regions to which respective surface effects are given. Therefore, as for pixels adjacent to where it has been determined as an identical surface effect, the clear processing 56 determines that those pixels are included in the region to which the identical surface effect is given. Specifically, in each image region in which the number of fusing times of clear toner is the same, the density values are of the identical range. As descried, the clear processing 56 determines a region to which a surface effect is given, and the type of surface effect to be given to the region. According to the determination, the clear processing 56 then determines whether to turn on or off the glosser 80 (step S4).

Subsequently, the clear processing 56 of the DFE 50 appropriately generates 8-bit image data of a clear toner plane to adhere clear toner, appropriately using the respective 8-bit image data of CMYK subjected to the gamma correction (step S5). The halftone engine 55 converts the 8-bit image data of a clear toner plane using 8-bit image data into 2-bit image data of a clear toner plane by the halftone processing (step S6).

Subsequently, the si3 unit 57 of the DFE 50 integrates the respective 2-bit image data of CMYK subjected to the halftone processing and 2-bit image data of a clear toner plane generated at step S6, and outputs the integrated image data and the on/off information indicating whether to turn on or off the glosser 80 to the MIC 60 (step S7).

When the clear processing 56 does not generate image data of a clear toner plane at step S5, only the respective 2-bit image data of CMYK, subjected to the halftone processing acquired at step S3 are integrated to be output to the MIC 60 at step S7.

Specific examples are explained according to types of surface effect. Herein, each type of the mirror finish gloss and the solid gloss to give a gloss, and the halftone dot matt and the matt to reduce a gloss is specifically explained. Moreover, a case in which a single type of surface effect is specified within one page is explained. At step S4, the clear processing 56 of the DEE 50 refers to the surface-effect selection table shown in FIG. 4, and determines that the surface effect specified for pixels having the density values of "238" to "255" is the mirror finish gloss, using the density value indicated by each pixel of the 8-bit gloss control plane. In this case, the clear processing 56 of the DEE 50 determines whether the region for which the mirror finish gloss is specified as the surface effect corresponds to the entire region specified by image data. When the determination result is positive, the clear processing 56 of the DFE 50 generates an inverse mask by, for example, Equation (1) using image data that corresponds to the region in the respective 8-bit image data of CMYK subjected to the gamma correction. What expresses the inverse mask is to be image data of a clear toner plane used in the printer unit 70. Note that because image data of a clear toner plane used in the low temperature fuser 90 is not used for this region, the DFE 50 does not generate image data of a clear toner plane used in the low temperature fuser 90. At step S7, the si3 unit 57 of the DFE 50 integrates the image data of a clear toner plane used in the printer unit 70 and the respective 2-bit image data of CMYK subjected to the halftone processing acquired at step S3, and outputs the integrated image data and the on/off information indicating on of the glosser 80, to the MIC 60. The MIC 60 outputs the image data of CMYK color planes and the image data of a clear toner plane used in the printer unit 70 to the printer unit 70, and turns on the glosser 80 using the on/off information output from the DFE 50. The printer unit 70 forms a toner image corresponding to each toner on the by irradiating light beams from the exposer on the photoconductor using the image data of the color planes of CMYK and the image data of a clear toner plane output from the MIC 60, and transfers and fixes this toner image onto a recording material by applying heat and pressure at normal temperature. Thus, the clear toner adheres on the recording material in addition to the CMYK toner, thereby forming an image thereon. Thereafter, the glosser 80 applies pressure at high temperature and high pressure onto the recording material. Because image data of a clear toner plane is not output for the low temperature fuser 90, the recording material is ejected without applying clear toner in the low temperature fuser 90. As a result respective toner of CMYK and clear toner are compressed to have a uniform total adhesion amount in the entire region specified by the image data, and therefore, a high gloss can be produced on the surface of this region.

On the other hand, when the region for which the mirror finish gloss is specified corresponds to a part of the region specified by the image data, a following situation can occur. First, to the region for which the mirror finish gloss is specified, image data of a clear toner plane expressing the inverse mask described above is used. However, when the total adhesion amount of CMYK toner is set to a predetermined amount or more for all pixels other than those in the region, applied pressure by the glosses 80, the total adhesion amount of the CMYK toner in the region for which the mirror finish gloss is specified and the total adhesion amount of CMYK toner in the region in which the total adhesion amount of respective toner of CMYK is set to the predetermined amount or more and clear toner becomes uniform.

For example, when the total adhesion amount of CMYK toner is set the predetermined amount or more for all pixels constituting the region specified by the image data, the same result is produced as a case in which the mirror finish gloss is specified for the entire region specified by the image data.

Therefore, when the region for which the mirror finish gloss is specified as the surface effect corresponds to a part of the region specified by the image data, the OFF 0.50 generates image data of a clear toner plane that is same as one when the mirror finish gloss is specified to the entire region specified by image data, and after clear toner adheres on a recording material, pressure is applied thereon by the glosser 80. Subsequently, image data of a clear toner plane to be used in the low temperature fuser 90 is generated to give the surface effect of the matt to a region other than the region for which the mirror finish gloss is specified as the surface effect on the recording material pressed by the glosser 80.

Specifically, the DEE 50 generates the inverse mask by Equation (1), similarly to the description above, as image data of a clear toner plane to be used in the printer unit 70. Furthermore, the DFE 50 generates the solid mask by Equation (2) for a region other than the region for which the mirror finish effect is specified as the surface effect, as image data of a clear toner plane to be used in the low temperature fuser 90.

At step S7, the si3 unit 57 of the DEE 50 integrates the image data of a clear toner plane used in the printer unit 70, the image data of a clear toner plane used in the low temperature fuser 90, and the respective 2-bit image data of CMYK subjected to the halftone processing acquired at step S3, and outputs the integrated image data and the on/off information indicating on of the glosser 80, to the MIC 60.

The MIC 60 outputs, to the printer unit 70, the image data of CMYK color planes and the image data of a clear toner plane used in the printer unit 70 among image data output from the DFE 50, and turns on the glosser 80 using the on/off information output from the DFE 50, and outputs the image data of a clear toner plane used in the low temperature fuser 90 out of image data output from the DFE 50 to the low temperature fuser 90. The printer unit 70 forms an image on which CMYK toner and clear toner adhere on a recording material using the image data of the color planes of CMYK and the image data of a clear toner plane output from the MIC 60. Thereafter, the glosser 80 presses the recording material at high temperature and high pressure. The low temperature fuser 90 forms a toner image with clear toner using the image data of a clear toner plane output from the MIC 60, superimposes this toner image on the recording material that has passed through the glosser 80, and fixes the toner image onto the recording material by applying low temperature heat and pressure. As a result, in the region for which the mirror finish gloss is specified, respective toner of CMYK and clear toner are compressed to have the uniform total adhesion amount thereof, and therefore, a high gloss can be produced on the surface of the region. On the other hand, in a region other than the region for which the mirror finish gloss is specified, adhesion of clear toner with the solid mask after pressing by the glosser 80 causes unevenness on the surface, thereby reducing a gloss on the surface of the region.

Moreover, at step S4, the clear processing 56 of the DFE 50 refers to the surface-effect selection table, and determines that the surface effect specified for pixels having the density values of "212" to "232" is the solid gloss, using the density value indicated by each pixel of the 8-bit gloss control plane, and specifically, determines as a solid gloss type I for pixels having the density values of "228" to "232". In this case, the clear processing 56 of the DFE 50 generates the inverse mask using image data that corresponds to the region in the respective 8-bit image data of CMYK subjected to the gamma correction. What expresses the inverse mask 1 is to be image data of a clear toner plane used in the printer unit 70. Note that because image data of a clear toner plane used in the low temperature fuser 90 is not used for this region, the DFE 50 does not generate image data of a clear toner plane used in the low temperature fuser 90. At step S7, the si3 unit 57 of the DFE 50 integrates the image data of a clear toner plane used in the printer unit 70 and the respective 2-bit image data of CMYK subjected to the halftone processing acquired at step S3, and outputs the integrated image data and the on/off information indicating off of the glosser 80, to the MIC 60. The MIC 60 outputs, to the printer unit 70, the image data of CMYK color planes and the image data of a clear toner plane used in the printer unit 70 output from the DFE 50 and turns off the glosser BO using the on/off information output from the DFE 50. The printer unit 70 forms an image on which CMYK toner and clear toner adhere on a recording material using the image data of the color planes of CMYK and the image data of a clear toner plane to be used in the printer unit 70 output from the MIC 60. Because the glosser 80 is turned off, the recording material is to be pressed at high temperature and high pressure thereafter. Because image data of a clear toner plane is not output for the low temperature fuser 90, the recording material is ejected without applying clear toner in the low temperature fuser 90. As a result, the total adhesion amount of respective toner of CMYK and clear toner becomes comparatively uniform in the region for which the solid gloss is specified, and therefore as the surface effect, and a comparatively high gloss can be produced on the surface of this region.

Moreover, at step S4, the clear processing 56 of the DFE 50 refers to the surface-effect selection table, and determines that the surface effect specified for pixels having the density values of "23" to "43" is the halftone dot matt, using the density value indicated by each pixel of the 8-bit gloss control plane. In this case, the clear processing 56 of the DFE 50 generates image data expressing halftone as image data of a clear toner plane to be used in the printer unit 70. Note that because image data of a clear toner plane used in the low temperature fuser 90 is not used for this region, the DFE 50 does not generate image data of a clear toner plane used in the low temperature fuser 90. At step S7, the si3 unit 57 of the DFE 50 integrates the image data of a clear toner plane used in the printer unit 70 and the respective 2-bit image data of CMYK subjected to the halftone processing acquired at step S3, and outputs the integrated image data and the on/off information indicating off of the glosser 80, to the MIC 60. The MIC 60 outputs, to the printer unit 70, the image data of CMYK color planes and the image data of a clear toner plane used in the printer unit 70 that are image data output from the DFE 50, and turns off the glosser 80 using the on/off information output from the DFE 50. The printer unit 70 forms an image on which CMYK toner and clear toner adhere on a recording material using the image data of the color planes of CMYK and the image data of a clear toner plane output from the MIC 60. Because the glosser 80 is turned off, the recording material is not to be pressed at high temperature and high pressure thereafter. Because image data of a clear toner plane is not output for the low temperature fuser 90, the recording material is ejected without applying clear toner in the low temperature fuser 90. As a result, in the region for which the halftone dot matt is specified as the surface effect, halftone dot matt is added by clear toner, thereby forming unevenness on the surface and a gloss on the surface of this region is slightly reduced.

Furthermore, at step 34, the clear processing 56 of the DFE 50 refers to the surface-effect selection table, and determines that the surface effect specified for pixels having the density values of "1" to "17" is the matt, using the density value indicated by each pixel of the 8-bit gloss control plane. In this case, as for on or off of the glosser 80, when there is another surface effect specified within one page (described later), the clear processing 56 of the DFE 50 follows the setting thereof. The clear processing 56 does not generate image data of a clear toner plane used in the printer unit 70 when the glosser 80 is either on or off, and generates the solid mask as the image data of a clear toner plane used in the low temperature fuser 90. At step S7, the si3 unit 57 of the DFE 50 integrates the image data of a clear toner plane used in the low temperature fuser 90 and the respective 2-bit image data of CMYK subjected to the halftone processing acquired at step S3, and outputs the integrated image data and the on/off information indicating on or off of the glosser 80, to the MIC 60. The MIC 60 outputs, to the printer unit 70, the image data of CMYK color planes out of image data output from the DFE 50, and outputs, to the low temperature fuser 90, the image data of a clear toner plane out of image data output from the DFE 50 used in the low temperature fuser 90. The printer unit 70 forms an image on which CMYK toner adheres on a recording material using the image data of the color planes of CMYK output from the MIC 60. When the glosser 80 is turned on, the recording material is pressed at high temperature and high pressure by the glosser 80, and when the glosser is turned off, the recording material is not pressed at high temperature and high pressure. The low temperature fuser 90 forms a toner image with clear toner using the image data of a clear toner plane output from the MIC 60, superimposes this toner image on the recording material that has passed through the glosser 80, and fixes the toner image onto the recording material by applying low temperature heat and pressure. As a result, in the region for which the matt is specified as the surface effect, adhesion of clear toner with the solid mask causes unevenness on the surface, thereby reducing a gloss on the surface of the region.

Even in case in which different types of surface effects are specified in one page, the processing described above can be applicable. That is, when more than one surface effect is specified within one page, in the image data of a gloss control plane, each density value corresponding to a type of surface effect shown in FIG. 4 is set to pixels in a region to which each type of surface effect is given. That is, in the gloss control plane, for each type of surface effect, a region to which the surface effect is given is specified, and therefore, in the DFE 50, it can be determined that a range of pixels to which an identical density value is set in the image data of this gloss control plane is the region to which the identical surface effect is given, and each of the surface effects can be easily produced within one page.

Figure 6:
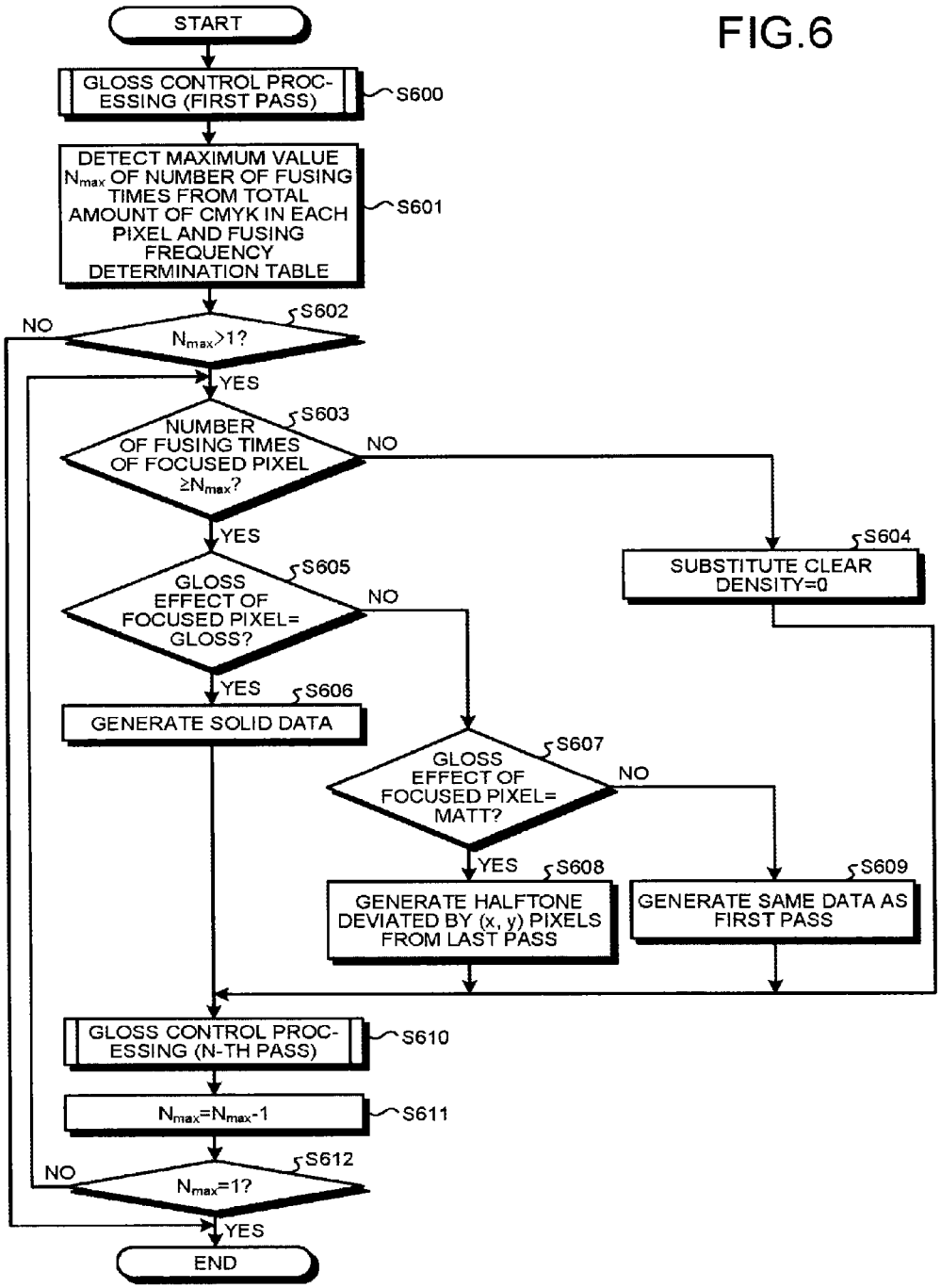
FIG. 6 is a flowchart indicating the gloss control processing when the image forming system performs fusing processing for multiple times (=N passes)

Next, operation when the image forming system performs fusing processing more than once is explained. FIG. 6 is a flowchart indicating the gloss control processing when the image forming system performs fusing processing for multiple times (=N passes).

At step S600, the DFE 50 performs gloss control processing similar to a case in which fusing processing is performed only one time (N=1 pass) (see FIG. 5).

Figures 7, 8:
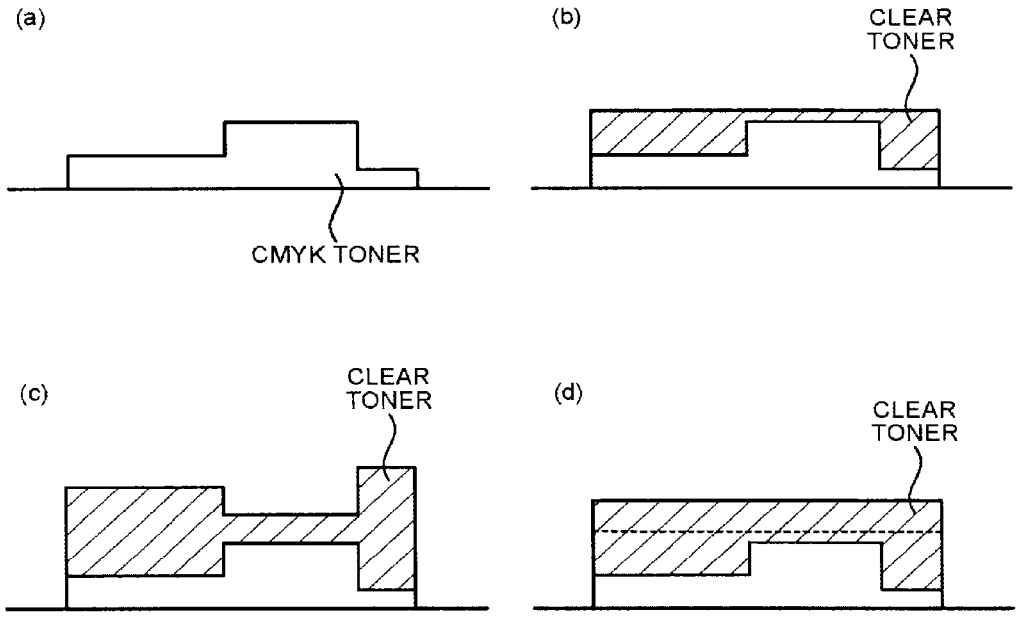
FIG. 7 is a fusing-frequency determination table in which the number of fusing times with which sufficient glossiness is obtained for each gloss effect is prescribed in advance.
FIGS. 8(*a*) to 8(*d*) are each a diagram exemplifying a fixation result of clear toner in a gloss region when N passes are performed.

At step S601, the DFE 50 detects a region having the maximum fusing frequency from among input image data, based on a total CMYK amount of each pixel and a fusing-frequency determination table (see FIG. 7).

At step S602, the DFE 50 determines whether or not a maximum value $N_{max}$ in the number of fusing times is larger than 1. When the maximum value $N_{max}$ in the number of fusing times is equal to or smaller than 1 (step S602: NO), it is considered that a sufficient result can be obtained with one pass, and because processing corresponding to the first one pass has been performed in the processing at step S600, the DFE 50 ends the gloss control processing. Moreover, when the maximum value $N_{max}$ in the number of fusing times is larger than 1 (step S602: YES), it is determined that processing with N passes is required, and proceeds to processing of step S603.

At step S603, the DFE 50 determines whether or not the number of fusing times of a focused pixel is equal to or larger than $N_{max}$. When the number of fusing times of the focused pixel is lower than $N_{max}$ (step S603: NO), not such high glossiness is required for the focused pixel, and the DFE 50 proceeds to processing step S604. Moreover, when the number of fusing times of the focused pixel is equal to or higher than $N_{max}$ (step S603: YES), the DFE 50 proceeds to processing at step S605. This processing is necessary to fix only a region having the maximum number prior to others. Thus, it can be arranged such that a region for which an effect of low glossiness is aimed to be produced is not influenced by N passes to achieve a region for which an effect of high glossiness is aimed to be produced (see FIG. 9 and FIG. 10).

At step S604, the DFE 50 sets a value of a clear plane to 0 (substitute 0 for density). That is, in this pixel, clear toner is not applied.

At step S605, the DFE 50 determines whether or not a gloss effect of a focused pixel is gloss. When the gloss effect of the focused pixel is not gloss (step S605: NO), the DFE 50 proceeds to processing at step S607. Moreover, when the gloss effect of the focused pixel is gloss (step S605: YES), the DFE 50 proceeds to processing at step S606.

At step S606, the DFE 50 generates solid data instead of inverse data for the gloss effect of the gloss, unlike the first pass. This processing is to enhance the glossiness by smoothing a surface of toner fixed on a recording material (see FIG. 8).

At step S607, the DFE 50 determines whether or not the gloss effect of the focused pixel is matt. When the gloss effect of the focused pixel is not matt (step S607: NO), the DFE 50 proceeds to processing at step S609. Moreover, when the gloss effect of the focused pixel is matt (step S607: YES), the DFE 50 proceeds to processing at step S608.

At step S608, the DFE 50 generates, for the gloss effect of matt, halftone that is deviated by several pixels from halftone generated at last pass to maintain smoothness. Specifically, DFE 50 generates halftone that is deviated by pixels of (x, y) from last pass. Note that x and y are the number of pixels that are smaller than a halftone cycle in a main scanning direction and a sub-scanning direction. That is, the DEE 50 generates, for a toner image formed on a recording material, a clear toner plane in which deviation smaller than the halftone cycle is created in the main scanning direction and the sub-scanning direction each time a clear toner plane is generated.

At step S609, the DFE 50 generates data same as that of the first pass, which is a solid image. The processing at step S609 is processing that is performed when it is determined as NO at processing of step S605 and step S607, and corresponds to a case of producing a watermark or a texture. In this example, smoothness can be maintained by simply using the same data as that of the first pass (because it is a solid image).

The DFE 50 repeats the processing at step S603 to step S609, to perform the processing on all pixels.

At step S610, the DFE 50 performs the gloss control processing at N-th pass by using a clear toner plane at N-th pass.

At step S611, the DEE 50 subtracts 1 from a value of $N_{max}$.

At step S612, the DFE 50 determines whether or not $N_{max}$ is 1. When $N_{max}$ is not 1 (step S612: NO), the DFE 50 returns to the processing at step S603 to generate a clear toner plane to be used at next pass. Moreover, when $N_{max}$ is 1 (step S612: YES), the DFE 50 ends the processing.

As described, by completing the entire processing from step S600 to step S612 by the DFE 50, surface effects are appropriately given to respective image regions indicated by image data to form an image.

FIG. 7 is the fusing-frequency determination table in which the number of fusing times with which sufficient glossiness for respective gloss effects can be acquired are prescribed in advance. This fusing-frequency determination table is stored, for example, in the DFE 50.

When clear toner is applied over color toner, basically, the glossiness tends to be higher as the total use amount of color toner increases. Therefore, the fusing-frequency determination table has a table configuration in which the number of fusing times varies according to the total amount (%) of CMYK. As described above, the DFE 50 determines the number of fusing times of each gloss effect based on this fusing-frequency determination table at the time of performing N passes, and performs the fusing processing from one having a larger number in fusing times prior to others (as for the sequence of the fusing processing, see FIG. 10). The fusing-frequency determination table is stored, for example, in the clear processing 56 shown in FIG. 3.

FIG. 8 is a diagram exemplifying a fixation result of clear toner in a gloss region when N passes are performed. When a clear toner plane of the first pass is generated, the surface-effect selection table shown in FIG. 4 is used. That is, data of inverse mask, halftone, and solid are generated for the gloss, the matt, and a watermark or a texture, respectively to perform fusing.

When an effect of gloss is to be given to a region in which color toner is present on a recording material as shown in FIG. 8(*a*), an inverse mask as shown in FIG. 8(*b*) is generated and overlaid thereon. In this case, the surface of clear toner on the recording material is uniform and a high gloss can be obtained. However, if the same clear toner as the first pass is simply overlaid at N-th pass, the uniformity is lost as shown in FIG. 8(*c*). Therefore, the DFE 50 overlays a solid image (part above a dotted line in the figure), not an inverse mask, thereon at the second pass and later as shown in FIG. 8(*d*) to make the surface uniform, thereby maintaining high glossiness (corresponding to the processing at step S605 to step S606 in FIG. 6).

Figure 9:
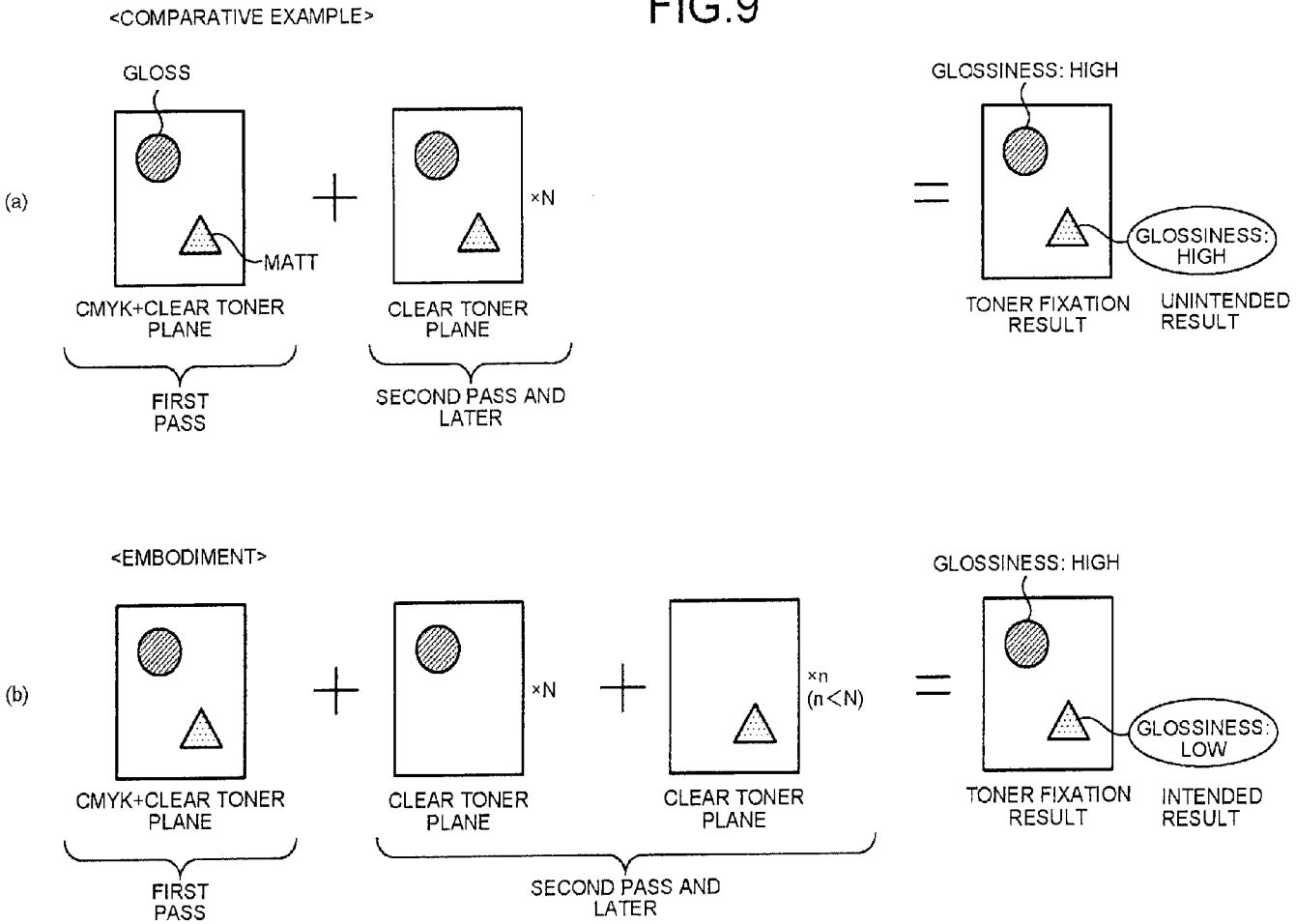
FIGS. 9(*a*) and 9(*b*) are each a diagram exemplifying a final print result when N passes are performed.

FIG. 9 is a diagram exemplifying a final print result when N passes are performed. As a comparative example shown in FIG. 9(*a*), if the same clear toner plane as the first pass is simply overlaid for multiple times, following a region having high glossiness, even in a matt region in which an effect of low glossiness is aimed to be produced, the glossiness becomes high. Therefore the DFE 50 performs N passes, dividing regions as shown in FIG. 9(*b*). For example, the DFE 50 performs the fusing processing minimum number of times for the matt region in which an effect of low glossiness is aimed to be produced. Specifically, it is achieved by the processing at step S603, step S611, and step S612 shown in FIG. 6.

Figure 10:
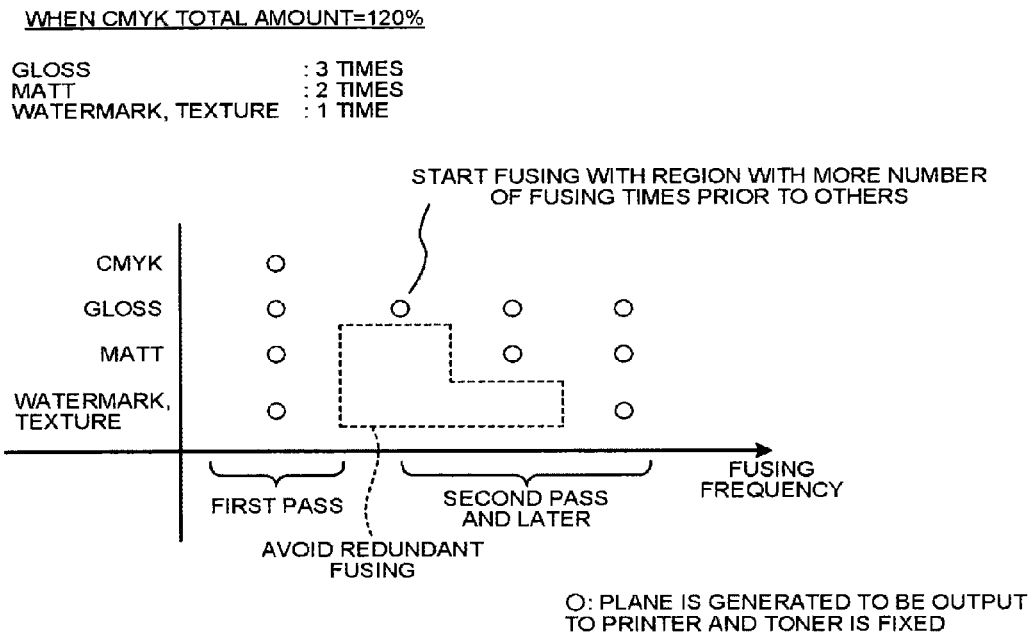
FIG. 10 is a diagram exemplifying a sequence in the fusing processing when N passes are performed.

FIG. 10 is a diagram exemplifying a sequence in the fusing processing when N passes are performed. As shown in FIG. 10, when the total amount of CMYK toner is 120%, which is the total toner amount of maximum density of a single color, according to the fusing-frequency determination table shown in FIG. 7, the number of fusing processing times of respective gloss effects are three times for the gloss, two times for the matt, and one time for a watermark or a texture. As explained in the processing at step S603 in FIG. 6, the fusing processing is performed first only on a region having the largest number of fusing processing time (=region requiring high glossiness), thereby avoiding redundant fusing processing of clear toner in the region in which an effect of low glossiness is aimed to be produced.

Second Embodiment

Although in the first embodiment, it is configured such that the clear processing 56 is arranged in the DFE 50, and the DFE 50 performs determination processing of the surface-effect selection table, and generation processing of data of a clear toner plane, it is not limited thereto.

That is, it may be configured such that either one of two or more kinds of processing that have been performed by one device is performed by one or more of other devices connected to the one device through a network.

As one example, in an image forming system according to a second embodiment of the present invention, a part of the functions of the DFE is implemented on a server device arranged on a network.

Figure 11:
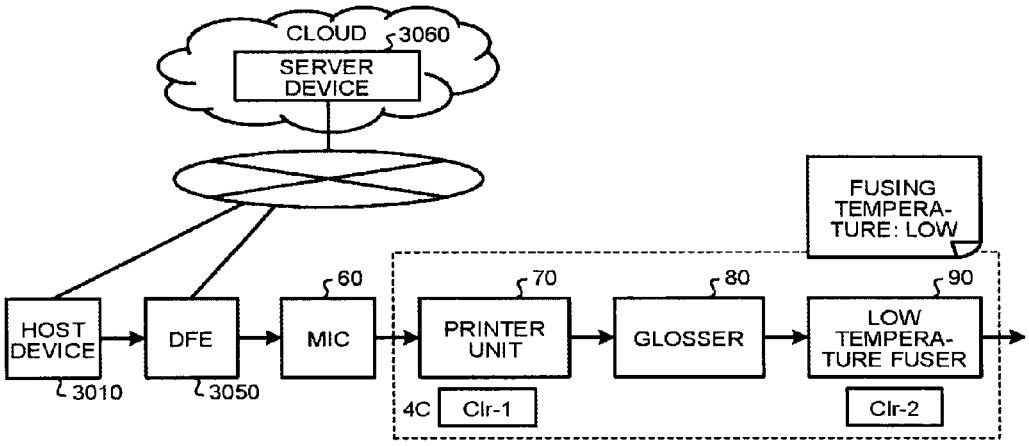
FIG. 11 is a block diagram showing a configuration of an image forming system according to a second embodiment of the present invention.

FIG. 11 is a block diagram showing a configuration of the image forming system according to the second embodiment.

As shown in FIG. 11, the image forming system according to the second embodiment includes a host device 3010, a DFE 3050, the MIC 60, the printer unit 70, the glosser 80, the low temperature fuser 90, and a server device 3060 that is arranged on a cloud. The postprocessors such as the glosser 80 and the low temperature fuser 90 are not limited thereto.

In the second embodiment, it is configured such that the host device 3010 and the DFE 3050 are connected to the server device 3060 through a network such as the Internet. Moreover, in the second embodiment, it is configured such that the module that performs generation processing of each plane data of the host device 10 of the first embodiment, and the clear processing 56 of the DFE 50 of the first embodiment are arranged in the server device 3060.

A connecting structure of the host device 3010, the DFE 3050, the MIC 60, the printer unit 70, the glosser 80, and the low temperature fuser 90 is the same as that of the first embodiment.

That is, specifically, it is configured such that in the second embodiment, the host device 3010 and the DFE 3050 are connected to the single unit of the server device 3060 through a network (cloud) such as the Internet, and the server device 3060 includes a plane-data generating unit 3062, a plane-data generating unit 3063, and a clear processing 3066, and the server device 3060 performs plane-data generation processing to generate color plane data, clear plane data, and gloss control plane data, generation processing of print data, determination processing of the surface-effect selection table, and generation processing of clear-toner plane.

Figure 12:
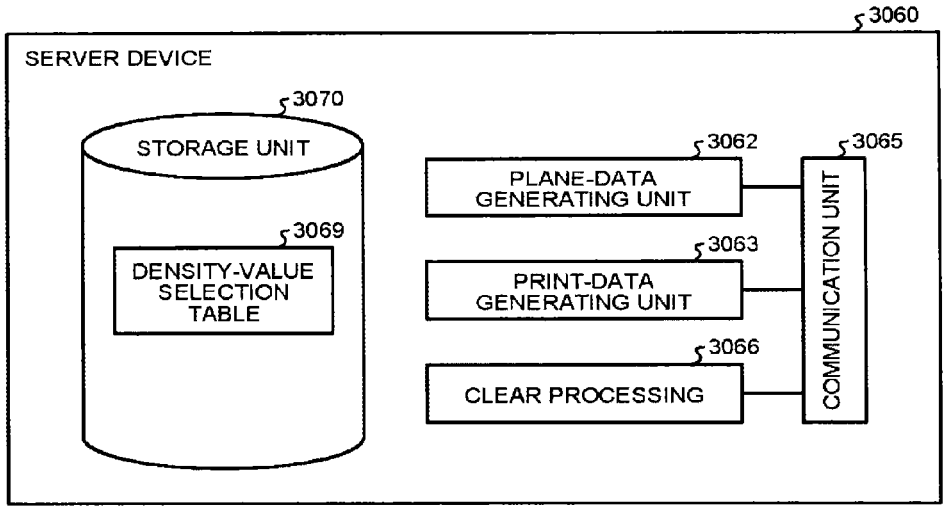
FIG. 12 is a block diagram showing a functional configuration of a server device according to the second embodiment.

First, the server device 3060 is explained. FIG. 12 is a block diagram showing a functional configuration of the server device 3060 according to the second embodiment. The server device 3060 primarily includes a storage unit 3070, the plane-data generating unit 3062, the clear processing 3066, and a communication unit 3065 as shown in FIG. 12.

The storage unit 3070 is a recording medium such as a hard disk drive (HDD) and a memory, and stores a density-value selection table 3069. The density-value selection table 3069 is the same as the surface-effect selection table of the first embodiment explained using FIG. 4.

The communication unit 3065 performs transmission and reception of various kinds of data or requests between the host device 3010 and the DFE 3050. More specifically, the communication unit 3065 receives image specification information and specification information, and a generation request of print data, and transmits the generated print data to the host device 3010. Furthermore, the communication unit 3065 receives 8-bit image data of a gloss control plane, 8-bit image data of a color plane, and a generation request of a clear toner plane, and transmits generated image data of a clear toner plane, and the on/off information to the DFE 3050.

The plane-data generating unit 3062 generates color plane data, gloss control plane data, and clear plane data, similarly to the host device 10 in the first embodiment.

The print-data generating unit 3063 of the second embodiment generates print data similarly to the host device 10 in the first embodiment.

The clear processing 3066 has similar functions as the clear processing 56 in the DFE 50 of the first embodiment.

Figure 13:
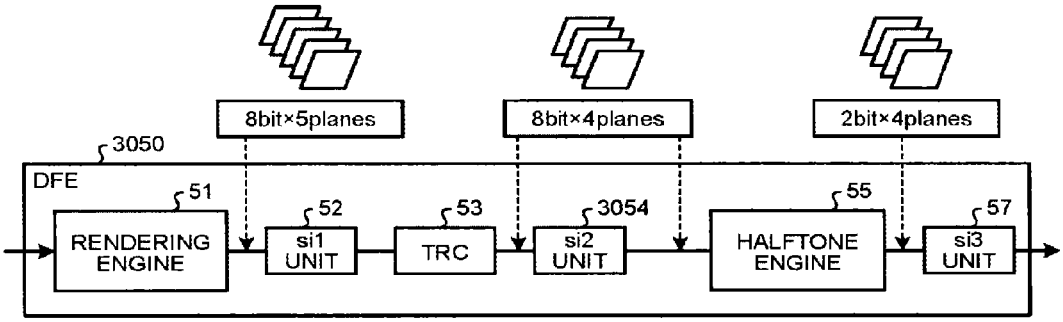
FIG. 13 is a block diagram showing a functional configuration of a DFE according to the second embodiment.

Next, the DFE 3050 is explained. FIG. 13 is a block diagram showing a functional configuration of the DFE 3050 according to the second embodiment. The DFE 3050 primarily includes the rendering engine 51, the si1 unit 52, the TRC 53, a si2 unit 3054, the halftone engine 55, and the si3 unit 57. Functions and configurations of the rendering engine 51, the sir unit 52, the TRC 53, the halftone engine 55, and the si3 unit 57 are the same as in the DFE 50 of the first embodiment.

The si2 unit 3054 of the second embodiment transmits 8-bit gloss control plane data subjected to the gamma correction by the TRC 53, 8-bit color plane data of CMYK, and a generation request of a color toner plane, to the server device 3060, and receives clear toner plane data and the on/off information from the server device 3060.

Figure 14:
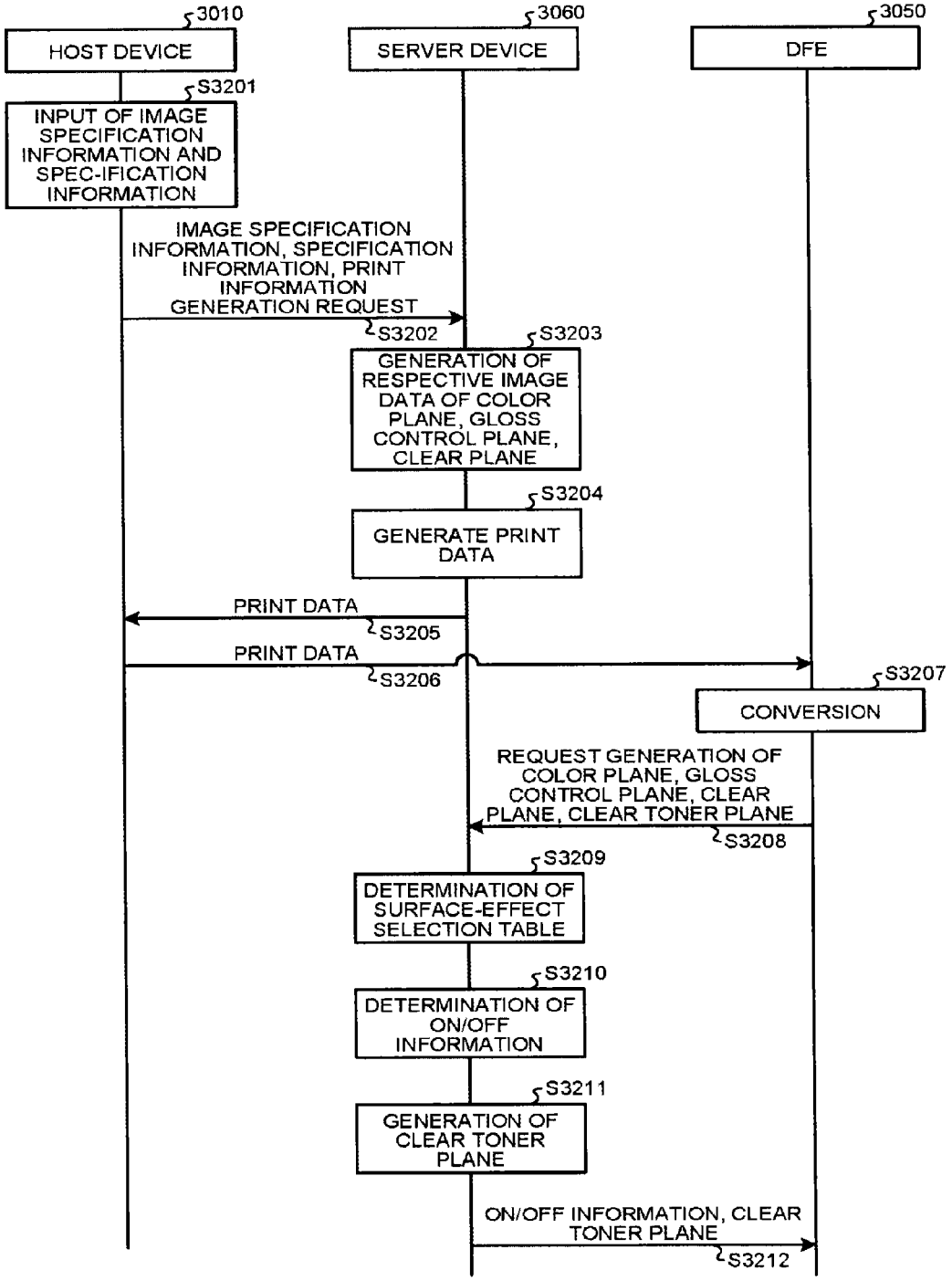
FIG. 14 is a sequence diagram showing an entire flow of a toner plane generation processing according to the second embodiment.

Next, generation processing of a clear toner plane that is required for print processing by the image forming system according to the second embodiment configured as above is explained. FIG. 14 is a sequence diagram showing an entire flow of a toner plane generation processing according to the second embodiment.

First, the host device 3010 receives input of image specification information and specification information by a user (step S3201), and transmits a print data generation request together with the image specification information and specification information to the server device 3060 (step S3202).

The server device 3060 receives the print data generation request together with the image specification information and the specification information, and generates image data of a color plane, image data of a gloss control plane, and image data of a clear plane (step S3203). The server device 3060 then generates print data from these pieces of image data (step S3204), and transmits the generated print data to the host device 3010 (step S3205).

Upon receiving the print data, the host device 3010 transmits this print data to the DFE 3050 (step S3206).

Upon receiving the print data from the host device 3010, the DFE 3050 analyzes the print data to acquire image data of a color plane, image data of a gloss control plane, and image data of a clear plane, and performs conversion, correction, and the like on these pieces of image data (step S3207). The DFE 3050 then transmits the image data of a color plane, the image data of a gloss control plane, the image data of a clear plane, and a clear-toner-plane generation request to the server device 3060 (step S3208).

Next, when the server device 3060 receives the color plane data, the gloss control plane data, the clear plane data, and the clear-toner-plane generation request, the clear processing 3066 acquires sheet information of a print object, and selects the surface-effect selection table based on the sheet information (step S3209). Such determination processing for the surface-effect selection table is performed similarly to the processing performed by the clear processing 56 of the DFE 50 of the first embodiment described above.

Subsequently, the server device 3060 determines on/off information (step S3210), and generates image data of a clear toner plane (step S3211). The server device 3060 then transmits the generated image data of a clear toner plane to the DFE 3050 (step S3212).

Processings performed hereafter by the MID 60, the glosser 80, and the low temperature fuser 90 are performed similarly to the first embodiment.

As described, in the second embodiment, generation of color plane data, gloss control plane data, clear plane data, print data, and clear-toner plane data, and determination processing of the surface-effect selection table are performed by the server device 3060 on a cloud, and therefore, in addition to the effects produced by the first embodiment, alteration or the like of the density-value selection table or the surface-effect selection table can be collectively performed, thereby providing facilities to an administrator.

Although in the second embodiment, it is configured such that the plane-data generating unit 3062, the plane-data generating unit 3063, and the clear processing 3066 are arranged in single unit of the server device 3060 on a cloud, and the server device 3060 performs the plane-data generation processing to generate color plane data, clear plane data, and gloss control plane data, the generation processing of print data, the determination processing of the surface-effect selection table, and the generation processing of clear-toner plane data, it is not limited thereto.

Figure 15:
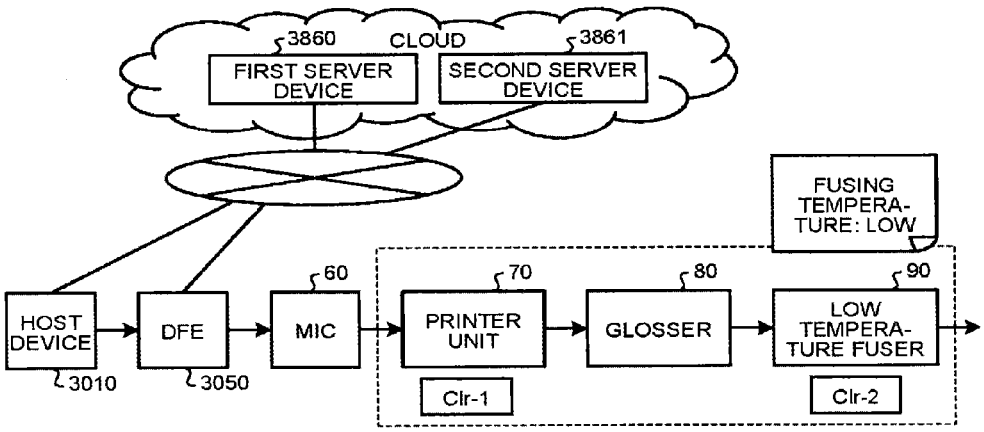
FIG. 15 is a network configuration diagram in which two servers are arranged on a cloud.

For example, it may be configured such that two or more units of server devices are arranged on a cloud, and the respective processing described above is distributed to two or more servers to be performed. FIG. 15 is a network configuration diagram in which two servers (a first server device 3860 and a second server device 3861) are arranged on a cloud. In an example shown in FIG. 15, it is configured to perform the plane-data generation processing to generate color plane data, clear plane data, and gloss control plane data, the generation processing of print data, the determination processing of the surface-effect selection table, and the generation processing of clear-toner plane data are distributed to be performed by the first server device 3860 and the second server device 3861.

For example, it can be configured such that the plane-data generating unit 3062 and the plane-data generating unit 3063 are arranged in the first server device 3860, and the plane-data generation processing and the generation processing of print data are performed in the first server device 3860, and the clear processing 3066 is arranged in the second server device 3861, and the determination processing of the surface-effect selection table, and the generation processing of clear-toner plane data are performed in the second server device 3861. A form of distribution of the respective processing to respective servers is not limited thereto, and it may take an arbitrary form.

That is, as long as the minimum required configuration is arranged in the host device 3010 and the DFE 3050, collective arrangement of a part of all of the plane-data generating unit 3062, the print-data generating unit 3063, and the clear processing 3066 in a single server device on the cloud, or distributed arrangement thereof in more than one server device can be arbitrarily practiced.

In other words, as the example described above, it can be configured such that either one out of multiple kinds of processing that has been performed by one device is performed by one or more units of other devices that is connected to one device through a network.

Moreover, in the case of the configuration in which processing is "performed by one or more units of other devices that are connected to one device through a network", the configuration includes data input/output processing that is performed between the one device and another device, or among other devices such as processing of outputting, from one device to another device, data (information) that is generated by the processing performed by the one device and processing of receiving the data by another device.

That is, when another device is a single unit, it is to be a configuration including input/output processing of data performed between one device and another device, and when other devices are two or more units, it is to be a configuration including input/output processing of data performed between one device and another device, and between other devices such as between a first other device and a second other device.

Furthermore, although in the second embodiment, the server device 3060, or multiple units of server devices such as the first server device 3860 and the second server device 3861 are arranged on a cloud, it is not limited thereto. For example, it may be configured such that the server device 3060 or the multiple units of server devices such as the first server device 3860 and the second server device 3861 are arranged on various kinds of networks such as an intranet.

Figure 16:
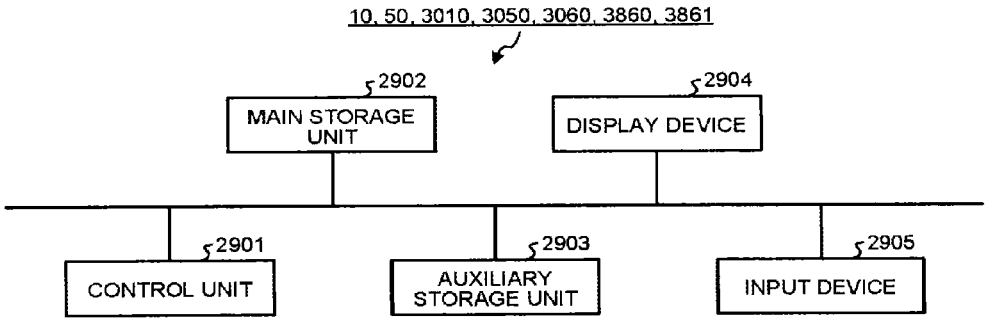
FIG. 16 is a hardware configuration diagram of a host device, a DFE, and a server device.

A hardware configuration of the host device 10, 3010, the DFE 50, 3050, the server device 3060, the first server device 3860, and the second server device 3861 is explained. FIG. 16 is a hardware configuration diagram of the host device 10, 3010, the DEE 50, 3050, and the server devices 3060, 3860, 3861. The host device 10, 3010, the DFE 50, 3050, and the server devices 3060, the first server device 3860, the second server device 3861 have, as a hardware configuration, a control device 2901 such as a central processing unit (CPU) that controls the entire apparatus, a main storage device 2902, such as a read-only memory (ROM) and random access memory (RAM), that stores various kinds of data and various kinds of programs, an auxiliary storage device 2903, such as an HDD, that stores various kinds of data and various kinds of programs, an input device 2905 such as a keyboard and a mouse, and a display device 2904, and has a hardware configuration using an ordinary computer.

An image processing program (including an image processing application, same hereafter) that is executed by the host device 10 and 3010 in the above embodiments is stored in a non-transitory computer-readable recording medium such as a compact-disc ROM (CD-ROM), a flexible disk (FD), a CD-recordable (CD-R), and a digital versatile disk (DVD), in a file in an installable format or an executable format, and is provided as a computer program product.

Moreover, it may be configured such that the image processing program that is executed by the host device 10 and 3010 of the above embodiments is stored in a computer that is connected to a network such as the Internet, and provided by being downloaded through the network. Furthermore, it may be configured such that the image processing program that is executed by the host device 10 and 3010 of the above embodiments is provided or distributed through a network such as the Internet.

Moreover, it may be configured such that the image processing program that is executed by the host device 10 and 3010 of the above embodiments is installed in, for example, ROM or the like in advance to be provided.

The image processing program that is executed by the host device 10, 3010 of the above embodiments has a modular structure including the respective components described above (the plane-data generating unit, the print-data generating unit, an input control unit, a display control unit), and as actual hardware, by reading and executing the image processing program from the above recording medium by a CPU, the respective components described above are loaded on the main storage device, and the plane-data generating unit, the print-data generating unit, the input control unit, and the display control unit are created on the main storage device.

Furthermore, print control processing performed by the DFE 0.50 and 3050 in the above embodiments may be implemented by a print control program as software, besides implementation by hardware. In this case, the print control program executed by the DFE 50 and 3050 in the above embodiments is installed in advance in a ROM or the like to be provided.

The print control program that is executed by the host device 10, 3010 in the above embodiments may be configured to be stored in a non-transitory computer-readable recording medium such as a CD-ROM, an FD, a CD-R, and a DVD, in a file in an installable format or an executable format to be provided as a computer program product.

Moreover, the print control program that is executed by the DFE 50 and 3050 in the above embodiments may be configured to be stored in a computer connected to a network such as the Internet, and to be provided by being downloaded through the network. Furthermore, the print control program that is executed by the DFE 50 and 3050 in the above embodiments may be configured to be provided or distributed through a network such as the Internet.

The print control program that is executed by the DFE 50 and 3050 in the above embodiments has a modular structure including the respective components described above (the rendering engine, the halftone engine, the TRC, the si1 unit, the si2 unit, the si3 unit, the clear processing), and as actual hardware, by reading and executing the print control program from the ROM described above by a CPU (processor), the respective components described above are loaded on the main storage device, and the rendering engine, the halftone engine, the TRC, the si1 unit, the si2 unit, the si3 unit, and the clear processing are created on the main storage device.

Furthermore, the generation processing of various data executed by the server device 3060 in the above embodiment may be implemented by a generation program as software, besides implementation by hardware. In this case, the generation program executed by the server device 3060 in the above embodiment is installed in a ROM or the like in advance to be provided.

The generation program of various data that is executed by the server device 3060 in the above embodiment may be configured to be stored in a computer-readable recording medium such as a CD-ROM, an FD, a CD-R, and a DVD, in a file in an installable format or an executable format to be provided as a computer program product.

Moreover, the generation program of various data that is executed by the server device 3060 in the above embodiment may be configured to be stored in a computer connected to a network such as the Internet, and to be provided by being downloaded through the network. Furthermore, the generation program of various data that is executed by the server device 3060 in the above embodiment may be configured to be provided or distributed through a network such as the Internet.

The generation processing of various data that is executed by the server device 3060 has a modular structure including the respective components described above (the plane-data generating unit, the plane-data generating unit, the clear processing), and as actual hardware, by reading and executing the generation processing from the ROM described above by a CPU (processor), the respective components described above are loaded on the main storage device, and the plane-data generating unit, the plane-data generating unit, and the clear processing are created on the main storage device.

Although in the above embodiment, the image forming system is configured to have the host device 10, 3010, the DFE 50, 3050, the MIC 60, the printer unit 70, the glosser 80, and the low temperature fuser 90, it is not limited thereto. For example, the DFE 50, 3050, the MIC 60, and the printer unit 70 may be integrally formed into a single unit of an image forming apparatus, and further, may be formed as an image forming apparatus that includes the glosser 80 and the low temperature fuser 90.

Although in the image forming system of the embodiment describe above, images are formed using multiple color toners of CMYK, images may be formed using single color toner.

Although a printer system of the embodiment described above has a configuration including the MIC 60, it is not limited thereto. It may be configured such that processing and functions of the MIC 60 described above are given to another device such as the DFE 50, and the MIC 60 is not arranged.

According to the present invention, an image can be formed, appropriately giving a surface gloss effect for each of image regions indicated by image data.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A printer control device that controls an image forming apparatus that forms an image on a recording material based on color planes for applying one or more color toners on the recording material and clear toner planes for applying clear toner on the recording material, and that fixes the one or more color toners and the clear toner on the recording material, the printer control device comprising:

a storage that stores therein, in a manner associated with each other, a total amount of density values of the one or more color toners, a surface effect being a visual effect or a tactile effect using the clear toner, and a number of times of overprinting that is a number of clear-toner-fusing times with which each of surface effects is satisfied; and circuitry that determines a number of times of overprinting required for satisfying each type of the surface effects based on the total amount of density values of one or more of color toners, wherein the printer control device controls the image forming apparatus so as to perform firstly overprinting for the surface effect that has a maximum number of times among the determined numbers of times of overprinting determined by the circuitry.

2. The print control device according to claim 1, wherein the circuitry generates a clear toner plane so as to smooth a surface of clear toner fixed on the recording material.

3. The print control device according to claim 2, wherein the circuitry generates, when a surface effect is a high gloss, a clear toner plane to be fixed first so as to make a total adhesion amount of color toner and clear toner uniform, and a clear toner plane to be fixed second and later so as to be solid.

4. The print control device according to claim 2, wherein the circuitry generates, when a surface effect is to reduce gloss, a clear toner plane that is deviated in each of a main scanning direction and a sub-scanning direction by an amount smaller than a halftone cycle, for a toner image that is formed on the recording material.

5. The print control device according to claim 4, wherein the circuitry produces deviation smaller than the halftone cycle in each of the main scanning direction and the sub-scanning direction each time a clear toner plane is generated.

6. The print control device according to claim 2, wherein the circuitry generates, subsequently to generation of a solid clear toner plane, a clear toner plane so as to smooth a surface of clear tone that is fixed on the recording material, by generating a solid clear toner plane.

7. A method for a printer control device that controls an image forming apparatus that forms an image on a recording material based on color planes for applying one or more color toners on the recording material and clear toner planes for applying clear toner on the recording material, and that fixes the one or more color toners and the clear toner on the recording material, the method comprising:

storing, in a manner associated with each other, a total amount of density values of the one or more color toners, a surface effect being a visual effect or a tactile effect using the clear toner, and a number of times of overprinting that is a number of clear-toner-fusing times with which each of surface effects is satisfied;

determining a number of times of overprinting required for satisfying each type of the surface effects based on the total amount of density values of one or more of color toners; and controlling the image forming apparatus so as to perform firstly overprinting for the surface effect that has a maximum number of times among the determined numbers of times of overprinting determined by the determining.

8. A non-transitory computer-readable storage medium including computer executable instructions, wherein the instructions, when executed by a computer, cause the computer to perform a method for controlling an image forming apparatus that forms an image on a recording material based on color planes for applying one or more color toners on the recording material and clear toner planes for applying clear toner on the recording material, that fixes the one or more color toners and the clear toner on the recording material, the method comprising:

storing, in a manner associated with each other, a total amount of density values of the one or more color toners, a surface effect being a visual effect or a tactile effect using the clear toner, and a number of times of overprinting that is a number of clear-toner-fusing times with which each of surface effects is satisfied;

determining a number of times of overprinting required for satisfying each type of the surface effects based on the total amount of density values of one or more of color toners; and controlling the image forming apparatus so as to perform firstly overprinting for the surface effect that has a maximum number of times among the determined numbers of times of overprinting determined by the determining.

9. The print control device according to claim 1, wherein, for a particular total amount of density values, a first surface effect of the surface effects has a different number of times of overprinting associated therewith than a second surface effect and a third surface effect.

* * * * *